United States Patent [19]

Reinehr et al.

[11] Patent Number: 5,013,504

[45] Date of Patent: May 7, 1991

[54] DRY SPINNING PROCESS WITH HOT AIR AND WITH SPINNING CELL OUTPUTS GREATER THAN 20 KG PER CELL PER HOUR

[75] Inventors: Ulrich Reinehr; Günter Türck; Rolf B. Hirsch; Hermann-Josef Jungverdorben, all of Dormagen, Fed. Rep. of Germany

[73] Assignee: Bayer Aktiengesellschaft, Leverkusen, Fed. Rep. of Germany

[21] Appl. No.: 411,078

[22] Filed: Sep. 22, 1989

[30] Foreign Application Priority Data

Sep. 28, 1988 [DE] Fed. Rep. of Germany ..... 3832872

[51] Int. Cl.[5] ..... D01F 6/18; D01D 5/04

[52] U.S. Cl. ..... 264/130; 264/206; 264/211.17

[58] Field of Search ..... 264/130, 206, 211.17

[56] References Cited

U.S. PATENT DOCUMENTS

| | | | |
|---|---|---|---|
| 3,458,616 | 7/1969 | Guess, Jr. et al. | 264/204 |
| 4,457,884 | 7/1984 | Reinehr et al. | 264/206 |
| 4,804,511 | 2/1989 | Pieper et al. | 425/72.2 |

FOREIGN PATENT DOCUMENTS

| | | |
|---|---|---|
| 0098477 | 1/1984 | European Pat. Off. . |
| 0098484 | 1/1984 | European Pat. Off. . |
| 0098485 | 1/1984 | European Pat. Off. . |
| 1760377 | 12/1971 | Fed. Rep. of Germany . |
| 3225266 | 1/1984 | Fed. Rep. of Germany . |
| 3308657 | 9/1984 | Fed. Rep. of Germany . |
| 3515091 | 10/1986 | Fed. Rep. of Germany . |
| 3726211 | 2/1988 | Fed. Rep. of Germany . |
| 3634753 | 3/1988 | Fed. Rep. of Germany . |

*Primary Examiner*—Hubert C. Lorin

*Attorney, Agent, or Firm*—Sprung Horn Kramer & Woods

[57] ABSTRACT

A process for the dry spinning of synthetic polymers, in particular polyacylonitrile fibres, from solutions in high polar solvents, such as dimethylformamide, which are heated to 100°–150° C. shortly upstream of the spinneret and spun there by spinnerets having a certain shape, and in the spinning cell the specific energy supply is at least 0.090 kWh per $m^2$ of heated cell area, the cell is charged with at least 70 $m^3$ (S.T.P.) of hot air per hour, and the filaments are treated in the lower part of the cell with water or aqueous preparations, so that the temperature of the filaments which leave the cell is decreased below 110° C. Under these conditions, the unexpectedly high spinning cell outputs of at least 20 kg of PAN solid per spinning cell per hour can be achieved without yellowing or self-ignition of the filaments occurring.

6 Claims, No Drawings

DRY SPINNING PROCESS WITH HOT AIR AND WITH SPINNING CELL OUTPUTS GREATER THAN 20 KG PER CELL PER HOUR

The invention relates to a process for the dry spinning of synthetic polymers, in particular polyacrylonitrile fibres, from solutions in high polar solvents, such as dimethylformamide, which are heated to 100°-150° C. shortly upstream of the spinneret and spun there by spinnerets having a certain shape, and in the spinning cell the specific energy supply is at least 0.09 kWh per $m^2$ of heated cell area, the cell is charged with at least 70 $m^3$ (S.T.P.) of hot air per hour, and the filaments are treated in the lower part of the cell with water or aqueous preparations, so that the temperature of the filaments which leave the cell is decreased below 110° C. Under these conditions, the unexpectedly high spinning cell outputs of at least 20 kg of PAN solid per spinning cell per hour can be achieved without yellowing or self-ignition of the filaments occurring.

In the dry spinning of polyacrylonitrile (PAN) fibres which contain more than 85% by weight, preferably more than 92% by weight, of acrylonitrile, according to the prior art the spinning solution is spun by spinnerets in vertical spinning cells. The spinning solution is preferably heated to temperatures between 100° and 150° C. shortly upstream of the spinnerets, and the cell walls are heated to 150°-220° C. Hot air or inert gas at temperatures up to about 400° C. is conveyed past the filaments in the direction of the filaments, about 40 $m^3$ (S.T.P.)/h of hot air being blown in. In the spinning cell, a major part of the polar solvent (DMF) vaporises and is sucked off together with the spinning gas at the lower end of the cell. Depending on the fineness of the filament, spinnerets having about 200 to 2000 holes are used. The solidified, dry spun filaments are taken off at a speed of 200 to 500 m/min. The spun material is provided with an aqueous reviving agent on the slivers, preferably below the spinning cell, and is placed in cans, or, in the case of filament production, is treated with an oily reviving agent and wound on cops. Continuous tow processes, such as, for example, EP-A No. 98 485, EP-A No. 98 477 or EP-A No. 119 521, have also recently been described.

The output of such a dry spinning cell is finally determined by the geometry of the technical apparatus and by the amount of heat supplied to the spun filaments by the hot spinning gas and radiation from the heated cell walls (cf. Ullmanns Encyclopädie [Ullmanns Encyclopaedia], Volume 11, page 329, right-hand column).

As a rule, spinning cell outputs of about 8 to 15 kg of PAN solid per spinning cell per hour are reached in dry spinning. Spinning cell outputs of over 20 kg/h in dry spinning have already been disclosed in German Auslegeschrift No. 1,760,377, but a maximum output of 32 kg/h is achieved in the process cited only with a very special spinning head and method. The spinning solution jets emerging from a cylindrical and concentrically divided spinneret having 1000 spinning orifices are blown by a Kemp gas stream directed inwards towards the centre of the spinneret, the spinning solution jets being ejected at different temperatures from particular regions of the spinneret. At these high spinning cell outputs, it is obvious that spinning defects can be avoided only by means of the complicated spinning head having different flow characteristics of the spinning gas close to the spinneret and different solution temperatures within certain spinneret sectors.

The spinning cell output L can be calculated from the total spun titre $G_{ST}$ (dtex) as follows:

$$L = \frac{G_{ST}\,(dtex) \times \text{take-off (m/min)} \times 60}{10000 \cdot 1000}\ [\text{kg/cell/h}]$$

The total spun titre $G_{ST}$ (dtex)=g/10000 m) can be calculated from the following equation:

$$G_{ST} = \frac{P \times U \times K \times 0.94 \times 10000}{A \times 100}$$

where $G_{ST}$=Total spun titre (dtex)

$P$=Pump volume ($cm^3$)

$U$=Revolutions per minute ($min^{-1}$)

$K$=Concentration of the spinning solution ($g/cm^3$)

$A$=Take-off speed (m/min).

Recently, several processes for the continuous production of PAN fibres by the dry spinning method have been disclosed (cf. for example DE Nos. 3 308 657, 3 225 266 and 36 34 753).

It was one of the objects of the invention to achieve an increase in the output of the dry spinning cells, which increase would prove particularly advantageous in the continuous aftertreatment process (without spinning can).

The skilled worker knows in principle that the capacity of the spinning cell can be increased mainly via the number of spinneret holes, the take-off and the throughput and via the amount of heat supplied to the filaments. However, these parameters are subject to technical limits, which prevented an increase in output in the prior art. Thus, in the case of, for example, predetermined cell geometry (cell length and diameter), the number of spinneret holes cannot be increased freely and the take-off and throughput of spinning solution cannot be increased freely, since otherwise the spun filaments would no longer dry or would stick together. There are also limits to the extent to which the amount of spinning gas can be increased, owing to the occurrence of vibrations and turbulence in the spinning gas in the spinning cell. When air is used as the spinning gas medium, the spinning gas temperatures cannot be increased further, for example above 400° C., for safety reasons. Cell surface temperatures above 220° C., in particular 250° C., give rise to an ignition source through thermal decomposition of the polyacrylonitrile when it comes into contact with the inner wall of the cell. Furthermore, considerable problems with natural shade are caused by high temperatures in filaments when they enter the surrounding air. Another possible method of obtaining higher spinning cell outputs by increasing the cell dimensions (longer and wider spinning cells) and thus increasing the gas and energy supplies while maintaining permitted temperatures likewise has natural limits. On the one hand, such dry spinning apparatuses must be simple to handle and easy to operate, as, for example, in the case of initial spinning, during spinneret change or the elimination of spinning problems, while on the other hand certain safety regulations, for example with regard to the danger of cell fire and deflagration, must be observed. All these considerations indicate the variety of ways in which the prevailing general conditions set limits with regard to an increase in the spinning cell capacity.

It was the object of the present invention to provide a dry spinning process for PAN fibres having increased spinning cell outputs of at least 20 kg/of PAN solid per spinning cell per hour, without the safety aspects being impaired or the other parameters being increased beyond their permitted limits. The spun material obtained should have defect levels which are as low as possible and should be capable of being introduced into the aftertreatment step both discontinuously by the customary processes (intermediate storage in cans) and, preferably, directly and continuously (without intermediate storage).

It has now been found, surprisingly, that the above object can be achieved if certain parameters and process steps are combined.

The invention thus relates to a process for the production of PAN fibres by the dry spinning method using hot air as the spinning gas medium, by spinning from hot PAN solutions in highly polar solvents, through annular spinnerets having a large number of holes, with spinning gas jets and spin finishing, characterised in that, with a predetermined cell geometry (round spinning cells of 270 to 300 mm, preferably 275 to 285 mm, in particular about 280 mm diameter), (a) the spinning cell output is at least 20 kg of PAN solid per spinning cell per hour, preferably 20 to 50, in particular 20 to 40, kg per cell per hour, with DMF contents of less than 30% by weight in the spun material,
(b) the amount of hot air used is at least 70 $m^3$ (S.T.P.)/h, preferably 70 to 100, in particular 70 to 80, $m^3$ (S.T.P.)/h,
(c) the spinning air is at a temperature of at least 360° C., preferably 360° to 400° C., with spinning gas jets directed from top to bottom, essentially parallel to the direction of the groups of filaments,
(d) the cell wall temperature is at least 200° C., preferably 200° C. to 220° C.,
(e) the specific energy consumption is at least 0.09 kWh per kg of PAN solid and per $m^2$ of heated surface,
(f) the hole density of the annular spinnerets is not more than 10.5 holes per $cm^2$ of annular spinneret surface area,
(g) the hole spacing with at least 500, preferably 500 to 2500, holes on the annular spinneret is at least 2.8 mm,
(h) spin finishing of the filaments is carried out inside the spinning cell, with water and/or an aqueous/oil-containing preparation,
(i) the minimum amount of water or aqueous/oil-containing spin preparations provides more than 10% by weight of moisture, based on PAN solid in the filament on leaving the spinning cell and
(k) the temperature of the spun filaments, measured at the cell outlet, is below 110° C., preferably below 100° C.

If hot air is used as the spinning gas medium, a large amount of spinning gas has to be used and, with a predetermined spinning cell geometry, the specific energy supplied to the spun filaments must be at least 0.09 kWh per $m^2$ of heated cell wall and per kg of PAN solid. This specific energy consumption is composed of the energy of the spinning gas fed in and the electrical energy required to heat the spinning cell. Both energy consumptions can be specified in kilowatt (kW) by tapping the appropriate units by means of clip-on probes. In the case of the determination of the spinning gas energy, the measurement is carried out directly downstream of the so-called air heater. The amount of spinning air is determined using appropriate orifice meters. In the case of the circular cells used, the heated area of the cell wall (measured in $m^2$) is calculated using the formula for a cylindrical area, from the cell length (m)×cell diameter (m)×$\pi$. The stated specific energy consumption of 0.09 kWh per $m^2$ per heated cell wall and per kg of PAN solid passed through represents the lower limit at which spinning is possible without sticking and with cell outputs of at least 20 kg of PAN solid per spinning cell per hour. With a lower specific energy supply (cf. Table 1, Examples 11 and 14), the defect level in the spun material increases considerably or dry spinning is no longer possible. The quality of the spun material was determined in terms of the number of spinning defects per 100000 spinning capillaries. If the number of spinning defects is less than 10 per 100000 capillaries, it is possible to speak of a good spinning picture. In normal dry spinning with spinning cell outputs of about 10 kg of PAN solid per spinning cell per hour, the specific energy consumption in the case of air as the spinning gas medium and a spinning gas feed of about 40 $m^3$ (S.T.P.)/h is about 0.05 kWh per $m^2$ of heated area and per kg of PAN solid.

Because of the problems described initially with regard to the explosion limits, the danger of cell fire, the danger of deflagration and the danger of pyrolysis when PAN filaments are overheated, the energy supply cannot simply be increased by the desired extent in order to increase the spinning cell capacity to 20 kg of PAN solid/hour. Details on the combustion behaviour and the combustion mechanism of PAN fibres are described, for example, in Melliand Textilberichte 53 (1972), pages 1395 to 1402, in particular page 1400, and 58 (1957), pages 52 to 59, in particular page 55. Thus, for example, the ignition temperature of PAN fibres is 245° C. (cf. Chemiefasern/Text. industrie [Manmade fibres/-Textile Industry], July 1972, page 661, right-hand column: Thermische Kennwerte von Faserstoffen [Thermal characteristics of fibre materials]). At 280° C., still decomposition of PAN fibres finally begins, toxic pyrolysis products, such as nitriles, HCN and carbon monoxide, also being formed.

It has now been found, surprisingly, that, despite a high specific energy supply of at least 0.09 kWh/$m^2$ of heated area per kg of PAN and large amounts of hot air supplied, it is possible to carry out dry spinning with a high spinning cell capacity of at least 20 kg of PAN solid per h per cell only when certain spinning parameters are maintained and in particular the filament temperature of the spun filaments still inside the hot spinning cell is reduced, preferably with water or with an aqueous oil-containing spin finish by treatment in the lower cell region, in such a way that the temperature of the spun filaments when they leave the cell and come into contact with the surrounding air is below 110° C., preferably below 100° C. Normally, the first spin finish is effected in the PAN dry spinning process outside the cell, before storage in the spinning can (cf. in this context R. Kleber: Avivagen und Avivierungsmethoden bei Chemie-Schnittfasern und kabeln [Reviving agents and reviving methods in manmade staple fibres and tows], Melliand Textilberichte 3/1977, pages 187 to 194, in particular the top of page 188). A suitable apparatus for the spin finishing of the spun filaments inside a spinning cell is described in detail, for example, in the application of DE-A No. 35 15 091. EP A No. 98 484 has also described a process where less than 10% is not applied inside the spinning cell. The minimum amount of moisture or spin finish necessary to cool the filaments to temperatures below 110° C. and still to achieve usable sliver formation from the individual filaments for further processing, for example in a continuous process or for winding on a cop is more than 10% of moisture, based on PAN solid. Sliver formation by the capillaries is understood as being the state in which the individual capillaries, after wetting and subsequent bundling in the spinning cell, are present as a closed, homogeneous composite structure, without entanglement of the individual filaments, and without individual filaments fibrillating during reeling or deflection. The packaging of the spun filaments which is characteristic of sliver formation, in homogeneous parallel layers without entanglement, is of considerable technical importance. This is also evident, for example, from German Offenlegungsschrift No. 3,726,211, where a wet-spun acrylic tow moist from the spinning process is dried after the precipitation process, with permitted shrinkage of 5–15%, to 100–10% by weight of moisture, with retention of the gel structure of the filaments, so that the said filaments can then be more readily aftertreated to give carbon fibres, without breakage of filaments. In contrast to the process according to the invention, the filaments in the case of wet spinning are, however, always moist from the spinning process and not dry, so that they too cannot be entangled and cannot stick to one another due to the influence of spinning solvent. In dry spinning, on the other hand, moistening of the previously dry filaments containing only residual solvent is carried out according to the invention prior to bundling, in order to prevent backing-up of the filaments, abrasion and electrostatic charges. An additional complication is the fact that, in the bundling of the filaments without prior moistening, the filaments may very readily stick together with formation of bristles, owing to the high energy data in the process according to the invention (for example, cell temperature of 200° to 220° C.; air temperature of 360° to 400° C.), the residual spinning solvent acting as an adhesive for the group of filaments. This is prevented, according to the invention, by carrying out moistening of the spun filaments during the actual bundling in the spinning cell itself. When the moisture contents or amounts of spin finish are smaller than consumption, the result is a liquid material which tends to wind (for further details, see Table 2).

Although DE No. 35 15 091 describes a process where spin finishing of the filaments is carried out at the lower end of the cell, the filaments should "be fed to the stretching apparatuses without heat loss". There too, spinning is not carried out with high outputs nor are other parameters (such as, for example, the high spinning gas feed) maintained.

If, as mentioned above, the filament temperature of the spun material is not reduced below 110° C., the filaments are found to stick together at higher filament temperatures, as described above. When the filament temperature is further increased, rapid yellowing with subsequent self-ignition occurs. Thus, if the filaments are not cooled with water, according to the invention, to the stated temperatures, the result at the high energy feeds is a filament which, on emerging from the spinning cells, at least exhibits very pronounced yellowing but in most cases begins to glow.

The temperature of the spun filaments was measured by a non-contact method using a KT 15 radiation thermometer (manufacturer Heimann GmbH, Wiesbaden, FRG), directly after emergence of the filaments from the spinning cell. In the dry spinning of PAN filaments in hot air, the required specific energy of 0.09 kWh per $m^2$ of heated area per kg of PAN solid can be introduced for achieving a spinning cell capacity of at least 20 kg of PAN via the heated spinning cell area, for example 7.6 $m^2$ of heated cell wall in the Examples according to the invention, and via the amount of gas.

However, it is found that, at such high energy feeds, which may load to contents of less than 2% by weight of DMF in the spinning solution, static charges occur on the filaments during bundling or glowing may even be induced on contact with metal parts of the cell (cf. also Example 2).

If spin finishing of the spun filaments is not carried out inside the spinning cell to effect cooling and bundling, it is possible to remove charge-free filaments from the spinning cell with relatively high DMF contents of about 5 to 30%, but the filaments are partially stuck to one another and the sliver from the cell feels hard ("boardy"). As indicated by cross-sectional photographs of such samples under the optical microscope, entire filament bundles are frequently stuck to one another and can no longer be separated into individual capillaries. Furthermore, the filaments exhibit a yellowish to yellow natural shade. All these adverse effects of high-performance spinning can be avoided according to the invention, particularly if the filaments are spin finished with water as described under bundling with cooling inside the spinning cell, even if the DMF content in the spun material is very low (<2% of DMF, preferably <1% of DMF).

In dry spinning, the spinning gas is generally fed in above the spinneret, parallel (in the middle and outside) to the spun filaments. As shown by spinning tests with spinning cell outputs of at least 20 kg of PAN solid per h per cell, air volumes of at least 70, preferably 70 to 100, in particular 70 to 85, $m^3$ (S.T.P.)/h are required at these cell outputs in order to keep the defect level during spinning at <10 per 100000 capillaries, as required for industrial production methods. At the required high spinning performance, such high air volumes cannot be employed by the transverse jet methods according to DE No. 34 24 343 which in principle are preferred to the dry spinning process, as shown in the Examples.

The hole density L also has an effect during dry spinning. It is defined as the number of spinneret holes per $cm^2$ of the spinneret surface. The smaller the hole spacing on the spinneret surface, the more difficult it is for the spinning gas medium to reach the individual filaments. For a predetermined spinning cell geometry, annular spinnerets having a hole density L of up to 10.5/$cm^2$ can still be successfully used with an air feed of at least 70 $m^3$ (S.T.P.); the hole spacing on the spinneret should be at least 2.8 mm. In dry spinning processes according to the prior art, a preferred embodiment comprises feeding the spinning gas into the upper part of the spinning cell and blowing the filaments transversely from the inside outwards via a relatively short, cylindrical gas distributor (cf. DE-A No. 34 24 343). As appropriate spinning tests with air as the spinning gas have shown, however, considerable spinning problems in the form of fluctuations in titre, sticking of the filaments and thick and thin areas, etc. occur on the filaments in the case of annular spinnerets having more than about 1200 holes and hole densities greater than 6 holes/cm$^2$. Here, the effect of the transverse flow is evidently virtually completely suppressed by the drag effect of the filaments in a downward direction. As shown in Examples 13 to 16, a good spinning picture can probably be achieved with a smaller amount of spinning gas (cf. Example 13). In this case, however, spinning cell outputs of at least 20 kg of PAN solid per hour are not achieved in any event, and this method therefore cannot be used for the process according to the invention.

As is also shown by the spinning tests, the DMF contents of the spun material obtained according to the invention, even for coarse titres, are as a rule substantially below 30% by weight and it is therefore possible to produce filaments having low defect levels, despite the high spinning cell outputs.

This is only possible by means of the high specific energy feed via the heated cell surface. The finding is of such great importance because, at high DMF values (>30% of DMF in the spun material), individual capillaries very readily stick together to form so-called bristles, which may make the filaments impossible to use.

The process according to the invention can be used both for a discontinuous process and in particular for the recently disclosed continuous spinning and after-treatment method. In the continuous process, the spin finish applied in the cell is sufficient, even with very small amounts of applied oil, for example 0.1 to 0.2% by weight (compared with 0.3% by weight or more in the discontinuous process), to allow the filaments to pass through all process stages, since no further wash process is carried out.

In the discontinuous process, in which a wash is effected, the spin finish applied in the cell is washed out again (for the most part) and (subsequent) spin finishing of the tow (comprising many slivers) is appropriate.

The Berger whiteness $W_B$ was determined by measuring the tristimulus values X, Y, Z in a Hunter three-filter photometer. The following relationship is applicable:

$$W_B = R_y + 3(R_7 R_x)$$

$$X = 0.783R + 0.198R_7$$

$$Z = 1.183R_7$$

The Examples below serve to illustrate the invention in more detail without restricting it. All percentages are by weight, unless stated otherwise.

EXAMPLE 1

An acrylonitrile copolymer having a K value of 83 and obtained from 93.6% by weight of acrylonitrile, 5.7% by weight of methyl acrylate and 0.7% by weight of sodium methallyl sulphonate is dissolved in dimethylformamide at 80° C. so that a 29.5% strength by weight spinning solution (amount relative to amount of solution) is formed. The spinning solution was heated to 135° C. in a preheater and was spun from an annular spinneret having 1380 holes distributed over 12 rings, each having 115 holes. The minimum hole spacing is 3.5 mm. The hole density L is 7.2 holes per cm$^2$ and the (circular) spinneret holes have a diameter of 0.2 mm. The spun filaments were blown with spinning air at 360° C., parallel to the running direction of the filament. 70 m$^3$ (S.T.P.) of air, measured as "standard m$^3$ at room temperature", per hour were passed through the spinning cell (diameter 280 mm) as spinning gas. The heated spinning cell area is 7.6 m$^2$. Spinning was carried out at a cell temperature of 200° C. 1388 cm$^3$/min of spinning solution were forced through the cell. The filaments were taken off at 300 m/min and, in the spinning cell itself, were bundled via 2 Y-shaped forks located opposite one another and staggered in height and were simultaneously wet with water (apparatus according to DE-A No. 35 15 091) so that the moisture content of the filaments is 15.3% by weight, relative to the solid content. The spun filaments leave the spinning cell at a filament temperature of about 104° C. The spinning cell output for the resulting titre of 9.3 dtex was 23.0 kg of PAN solid per hour. The spun material had less than 5 defects per 100000 capillaries (result of 20 different tests on different spinning runs), the following being evaluated as defects: filaments stuck together and thick and thin filaments. The DMF content of the spun material was 19.3%. The Berger whiteness is 45.6. The energy consumption of the spinning gas, measured downstream of the air heater and before entry into the spinning cell, is 8.3 kWh and the energy consumption of the heated cell walls was measured at 8.4 kWh. This gives a specific energy consumption of 0.095 kWh per kg of PAN solid and per m$^2$ of heated spinning cell surface.

Table 1 below lists further spinning runs, where an acrylonitrile spinning solution according to Example 1 was used. The parameters altered compared with Example 1 are shown in the Table.

As can be seen in Table 1, the process according to the invention is suitable for the production of a very wide range of titres (cf. Examples 1t1 to 5t1). In the case of titres up to about 10 dtex, the numbers of holes are preferably greater than 1000, preferably greater than 1500 (up to about 2500). In the case of titres up to about 20 dtex, the numbers of holes used are preferably greater than 1000 (up to about 2000), and in the case of titres above 30 dtex the numbers of holes used are preferably greater than 500 (up to about 1500). Example 6 shows that, in spite of a low hole density, the number of spinning defects is substantially greater than 100 per 100000 capillaries when the hole spacing is too small. A similar situation is encountered in Example 7t1. Here, where the hole spacing is greater, the high defect level is due to too high a hole density. The spinning gas no longer reaches all filaments and in particular does not reach the filaments at the middle spinning rings. From hole densities of 10.5 cm$^2$ and hole spacings of at least 2.8 mm, however, satisfactory spinning (cf. Example 1) is achieved. From Example 8t1, it is evident that the spinning defect level increases substantially when the amount of spinning gas is too small. When the temperature of the spinning air is low (cf. Example 9t1), a similar situation is encountered. In Example 10, the temperature of the spinning gas was increased to 400° C. Example 11t1 shows that, when the specific energy consumption is too low (0.862 kWh per kg of PAN per m$^2$ of heated surface), the spinning picture is unsatisfactory. In Example 12t1, the cell temperature was increased to 210° C. In the subsequent Examples 13t1 to 16t1 of Table 1, the spinning gas was fed into the upper part of the cell and flowed against the filaments from the inside outwards via a cylindrical gas distributor (cf. DE-A No. 34 24 343). In Example 13t1, it is true that good spinning characteristics are recorded with regard to the level of spinning defects using 1155-hole spinnerets at a cell output of (only) 12 kg/h. If, however, as described in Example 14t1, the spinning cell output is increased to 20 kg of PAN solid per hour, spinning is no longer possible. Amounts of air greater than 50 $m^3$ (S.T.P.)/h cannot be fed to the spinning cell (cf. Example 16t1) because, in this gas distributor with transverse flow with respect to the filaments, the filaments are deflected excessively and strike the cell wall. As shown in Example 16t1, spinnerets having ≧1380 holes are unsuitable for this spinning technique. The outer rings of holes on the annular spinneret are not reached by all the spinning air. The inner groups of filaments act as a curtain against the outflowing spinning air.

TABLE 1

| Example | 1 tl | 2 tl | 3 tl | 4 tl | 5 tl | 6 tl | 7 tl | 8 tl |
|---|---|---|---|---|---|---|---|---|
| Number of spinneret holes | 2002 | 1638 | 1638 | 1155 | 592 | 2400 | 1264 | 1638 |
| Hole density L/$cm^2$ | 10.5 | 8.6 | 8.6 | 6.0 | 3.1 | 8.7 | 11.5 | 8.6 |
| Minimum hole spacing mm | 2.8 | 3.2 | 3.2 | 3.8 | 5.4 | 2.5 | 2.8 | 3.2 |
| Take-off m/min | 300 | 350 | 250 | 200 | 200 | 200 | 350 | 250 |
| Throughput of spinning solution $cm^3$/min | 1244 | 1243 | 1405 | 1565 | 1466 | 1639 | 1373 | 1403 |
| Spinning gas direction | vertical | vertical | vertical | vertical | vertical | vertical | vertical | vertical |
| Spinning gas volume $m^3$ (S.T.P.)/h | 70 | 70 | 70 | 70 | 70 | 70 | 70 | 60 |
| Spinning temp. °C. | 360 | 360 | 360 | 360 | 360 | 360 | 360 | 360 |
| Cell temp. °C. | 200 | 200 | 200 | 200 | 200 | 200 | 200 | 200 |
| Filament temp. °C. | 98 | 103 | 96 | 101 | 108 | 94 | 98 | 87 |
| Spinning titre dtex | 5.7 | 6.0 | 9.5 | 18.8 | 34.3 | 9.5 | 8.6 | 9.6 |
| Total titre dtex | 11500 | 9850 | 15580 | 21700 | 20330 | 22730 | 10880 | 15560 |
| Moisture content of filaments % | 17.5 | 15.5 | 19.1 | 16.6 | 11.9 | 22.2 | 17.4 | 27.9 |
| DMF content of filaments % | 17.3 | 16.7 | 19.9 | 22.5 | 29.3 | 39.4 | 18.3 | 23.7 |
| Berger whiteness | 53.5 | 54.0 | 47.1 | 44.5 | 41.0 | 44.1 | 48.4 | 49.0 |
| Defects per 100000 capillaries | 10 | 10 | 5 | 5 | 5 | 100 | 100 | 100 |
| Output. kg PAN/h | 20.7 | 20.6 | 23.5 | 26.0 | 24.4 | 27.3 | 22.8 | 23.5 |
| Spinning gas energy kWh | 8.3 | 8.3 | 8.3 | 8.3 | 8.3 | 8.3 | 8.5 | 7.5 |
| Cell energy kWh | 7.8 | 7.8 | 8.5 | 9.8 | 8.6 | 10.5 | 8.3 | 8.5 |
| Specific energy consumption kWh per kg of PAN per $m^2$ of heated surface | 0.102 | 0.102 | 0.094 | 0.091 | 0.091 | 0.090 | 0.095 | 0.089 |
| Comment | According to the invention | According to the invention | According to the invention | According to the invention | According to the invention | Not according to the invention | Not according to the invention | Not according to the invention |

| Example | 9 tl | 10 tl | 11 tl | 12 tl | 13 tl | 14 tl | 15 tl | 16 tl |
|---|---|---|---|---|---|---|---|---|
| Number of spinneret holes | 1638 | 1638 | 1638 | 1638 | 1155 | 1155 | 1155 | 1380 |
| Hole density L/$cm^2$ | 8.6 | 8.6 | 8.6 | 8.6 | 6.0 | 6.0 | 6.0 | 7.2 |
| Minimum hole spacing mm | 3.2 | 3.2 | 3.2 | 3.2 | 3.8 | 3.8 | 3.8 | 3.5 |
| Take-off m/min | 250 | 250 | 250 | 250 | 200 | 350 | 200 | 200 |
| Throughput of spinning solution $cm^3$/min | 1403 | 1403 | 1403 | 1403 | 750 | 1244 | 750 | 894 |
| Spinning gas direction | vertical | vertical | vertical | vertical | transverse | transverse | transverse | transverse |
| Spinning gas volume $m^3$ (S.T.P.)/h | 70 | 70 | 70 | 70 | 50 | 50 | 60 | 50 |
| Spinning temp. °C. | 320 | 400 | 360 | 360 | 360 | 360 | 360 | 360 |
| Cell temp. °C. | 200 | 200 | 180 | 210 | 200 | 200 | 200 | 200 |
| Filament temp. °C. | 96 | 97 | 106 | 101 | 94 | — | 109 | 104 |
| Spinning titre dtex | 9.6 | 9.6 | 9.6 | 9.6 | 9.0 | 9.0 | 9.0 | 9.0 |
| Total titre dtex | 15560 | 15560 | 15560 | 15560 | 10400 | — | 10400 | 12400 |
| Moisture content of filaments % | 19.2 | 18.0 | 12.2 | 16.5 | 21.8 | — | 10.8 | 14.4 |
| DMF content of filaments % | 23.9 | 15.2 | 31.1 | 15.6 | 13.3 | — | 12.3 | 28.2 |
| Berger whiteness | 52.3 | 42.2 | 51.7 | 40.1 | 45.8 | — | 44.9 | 51.6 |
| Defects per 100000 capillaries | 50 | 10 | 100 | 10 | 20 | — | 100 | 100 |
| Output, kg PAN/h | " | " | " | " | 12.5 | 20.7 | 12.5 | 14.1 |
| Spinning gas energy kWh | 7.8 | 8.8 | 8.3 | 8.3 | 5.8 | 5.8 | 6.9 | 5.8 |
| Cell energy kWh | 8.0 | 7.1 | 9.1 | 5.7 | 7.8 | 5.7 | 6.0 | 7.8 |
| Specific energy consumption kWh per kg of PAN per $m^2$ of heated surface | 0.091 | 0.094 | 0.086 | 0.097 | 0.121 | 0.086 | 0.132 | 0.110 |
| Comment | Not according to the invention | According to the invention | Not according to the invention | According to the invention | According to the invention | Not according to the invention | Not according to the invention | Not according to the invention |

EXAMPLE 2 (SEE 1t, TABLE 2)

(a) A PAN spinning solution, prepared according to Example 1, was spun as described there. However, the spun filaments were not finished at the lower end of the spinning cell with water or aqueous oil-containing reviving agent. The filaments assumed a pale brown discoloration on emerging from the cell into the air and were partially stuck together. The filament temperature on emergence from the cell was 127° C.; the DMF content of the filaments was 17.5%.

(b) Filaments according to Example 1 were finished outside the spinning cell with water or an aqueous oil-containing reviving agent. Breaks in the filament and back-up occurred constantly between the end of the cell, the spin finishing apparatus and the winding apparatus.

(c) In a further test series, the amount of water finish or of an aqueous finish containing an antistatic agent and lubricant was determined, and the filament temperature was measured directly after emergence from the spinning cell, for spun filaments produced according to Example 1. Furthermore, the spinning characteristics were evaluated. The spin finish used was a mixture of a lubricant and an antistatic agent having a concentration of 40 g/l. Suitable lubricants are, for example, glycols, silicones or ethoxylated fatty acids, fatty alcohols, fatty esters, fatty amides and fatty alkyl ether sulphates. Suitable antistatic agents are, for example, cationic, anionic or nonionic compounds, such as, for example, long-chain, ethoxylated, sulphated and neutralised alcohols.

As can be seen in Table 2, the moisture content of the spun filaments must be more than 10% by weight, relative to polymer solid, for good further processing. (See Experiments 1t2 to 7t2 in Table 2).

TABLE 2

| | Air spinning | | | | | | |
|---|---|---|---|---|---|---|---|
| Example No. | 1t2 | (2)t2 | (3)t2 | (4)t2 | 5t2 | (6)t2 | (7)t2 |
| Reviving agent | Water | Water | Water | Water | Spin finish | Spin finish | Spin finish |
| Amount ml/min | 80 | 70 | 60 | 50 | 80 | 70 | 60 |
| Moisture content of the filaments, % | 13.2 | 9.6* | 8.0* | 6.3* | 10.7 | 8.8* | 5.7* |
| Oil applied to filaments, % | — | — | — | — | 0.19 | 0.17 | 0.14 |
| Filament temp. °C. | 107 | 111 | 113 | 115 | 109 | 113 | 118 |
| Spinning characteristics | Good running on the cop and further processing | Beginning of "sliver rigidity" | Rough brittle capillaries fluid | Rough brittle capillaries no sliver formation | Good running on the cop and further processing | Beginning of sliver rigidity rough capillaries | Brittle capillaries stuck together No sliver formation |
| Comments | According to the invention | *Not according to the invention | *Not according to the invention | *Not according to the invention | According to the invention | *Not according to the invention | *Not according to the invention |

We claim:

1. In the production of PAN filaments by spinning a hot solution of PAN in DMF through an annular spinneret having a large number of spinning holes into a spinning cell provided with hot air, applying a finish to the formed filaments, and collecting the filaments, the improvement wherein (a) the spinning cell output is at least 20 kg of PAN solid per spinning cell per hour with a DMF content of less than 30% by weight, (b) the amount of hot air used is at least 70 $m^3$ (S.T.P.)/h, (c) the hot air is at a temperature of at least 360° C., with the air directed downwardly from top to bottom, essentially parallel to the direction of the fibers, (d) the cell wall temperature is at least 200° C., (e) the specific energy consumption is at least 0.09 kWh per kg of PAN solid and per $m^2$ of heated surface, (f) the hole density of the annular spinneret is not more than 10.5 holes per $cm^2$ of annular spinneret surface area, (g) the spinneret has at least 500 holes with a spacing at least 2.8 mm, (h) finishing the filaments inside the spinning cell, with water or an aqueous/oil-containing preparation, (i) the finish being applied in an amount to provide more than 10% by weight of moisture, based on PAN solid in the filament on leaving the spinning cell and (k) the temperature of the spun filaments, measured at the cell outlet, is below 110°.

2. The process according to claim 1, wherein in:

(a) the spinning cell output is 20 to 50 kg per cell per hour, (b) the amount of hot air used is 70 to 100 $m^3$ (S.T.P.)/h, (c) the hot air is at a temperature of 360° to 400° C., (d) the cell wall temperature is from 200° to 220° C., (g) the spinneret has 500 to 2500 holes, and (k) the temperature of the spun filaments is below 100° C.

3. The process according to claim 2, wherein in:

(a) the spinning cell output is 20 to 40 kg per cell per hour, and (b) the amount of hot air used is 70 to 80 $m^3$ (S.T.P.)/h.

4. The process according to claim 1, wherein the level of spinning defects in the spinning cell is $<10/100000$ filaments.

5. The process according to claim 1, wherein the spun filaments are aftertreated directly and continuously without storage, in spinning cans.

6. The process according to claim 1, wherein the spun filaments are collected in a spinning can and thereafter aftertreated.

* * * * *